United States Patent [19]

Shiang

[11] Patent Number: 4,776,110

[45] Date of Patent: Oct. 11, 1988

[54] INSOLE-VENTILATING SHOE

[76] Inventor: Joung-Lin Shiang, P.O. Box 10160, Taipei, Taiwan

[21] Appl. No.: 88,569

[22] Filed: Aug. 24, 1987

[51] Int. Cl.[4] ..... A43B 7/06; A43B 13/38

[52] U.S. Cl. ..... 36/3 B; 36/44; 128/588

[58] Field of Search ..... 36/3 R, 3 A, 3 B, 43, 36/44; 128/588

[56] References Cited

U.S. PATENT DOCUMENTS

| | | | |
|---|---|---|---|
| 1,134,389 | 4/1915 | Lack | 36/3 B |
| 1,390,929 | 9/1921 | Saudino | 36/3 R |
| 1,689,398 | 10/1928 | Lioy | 128/588 |
| 2,474,815 | 7/1949 | Brahm | 36/3 R |
| 2,604,707 | 7/1952 | Hicks | 36/3 R |
| 2,808,664 | 10/1957 | Frieder et al. | 36/44 X |
| 3,180,039 | 4/1965 | Burns, Jr. | 36/3 B |
| 4,078,321 | 3/1978 | Famolare, Jr. | 36/3 B |

FOREIGN PATENT DOCUMENTS

| | | | |
|---|---|---|---|
| 53447 | 5/1967 | Poland | 36/3 R |

*Primary Examiner*—James Kee Chi

[57] ABSTRACT

An insole-ventilating shoe includes: an insole having an air pumping device formed on a rear portion of the insole having an air guide protruding upwardly to exchange fresh air outside the shoe vamp, and plural ventilating grooves with through holes formed on a front portion of the insole for circulating air from the pumping device in the insole and shoe for comforting a wearer's foot.

6 Claims, 2 Drawing Sheets

INSOLE-VENTILATING SHOE

BACKGROUND OF THE INVENTION

U. S. Pat. No. 4,633,597, entitled "Elastic Pressure and Automatic-air-ventilation Type of Insole" disclosed by the same inventor of this application, taught an elastic air-sack type of insole adapted for making the air inside the shoes circulated by means of restoring effect of the air sack, which however has the following defects:

1. The air sack insole is made of an elastic film piece being closely attached to the edge of a flat insole, for instance, the air sack being made as a curved form closely pressed and fastened to an edge of the insole, which thereby increases the production inconvenience and cost since further pressing or fastening steps must be done for its processing.

2. The ventilating air intake and exhaust valves are formed on two sides of the insole, not highly formed on the shoe vamp, thereby influencing their sound ventilation, especially influencing the exchange of fresh air with the environmental air.

3. The front air orifices are generally formed on a front edge of the insole, which however if being cut for reducing its size for the snugly wearing by a user, the air ventilation effect will be greatly reduced so that the size of the insole must be predetermined, not suitable for a user's optional adjusting.

The present inventor has found the defects of his previous invention and invented the present insole-ventilating shoe.

SUMMARY OF THE INVENTION

The object of the present invention is to provide an insole-ventilating shoe including: an insole having an air pumping means formed on a rear portion of the insole having an air guide protruding upwardly to fluidically communicate with an environmental air outside the shoe vamp and plural air ventilating grooves arcuately formed on a front portion of the insole so that the shoe can be well ventilated by exchanging an inner dirty air with an outer fresh air as actuated by the air pumping means, and the insole can be optionally cut for snugly wearing purpose without influencing the air ventilation effect since plural arcuate grooves are still present underneath the toe portion of insole even few outer grooves already being removed.

DETAILED DESCRIPTION

Figure 1:
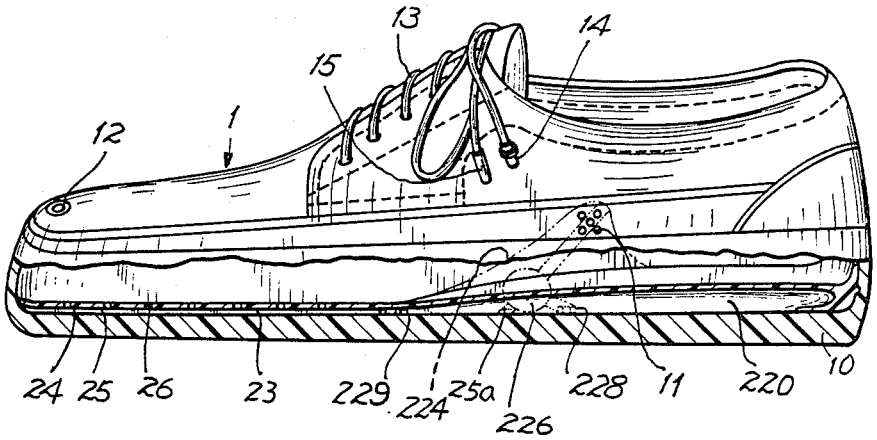
FIG. 1 is an elevational view of the present invention.

As shown in FIGS. 1–5, the present invention comprises: a shoe 1 having ventilating holes and an insole 2 embedded inside the shoe above a sole 10 having an air pumping means 22 and a plurality of air ventilating grooves formed underneath the insole 2.

The shoe 1 includes a waist ventilating hole 11 formed on a waist portion of a vamp, a front ventilating hole 12 formed on a toe cap, and a shoelace 13 having a sealing plug 14 mounted on the tip of the lace 13 and having the other tip wound with a shielding tape 15, adapted for sealing the front ventilating hole 12 in case of rain. The waist ventilating hole 11 may be shielded by a lower periphery of a wearer's trouser hose to prevent the penetration of rain water, if raining.

Figure 2:
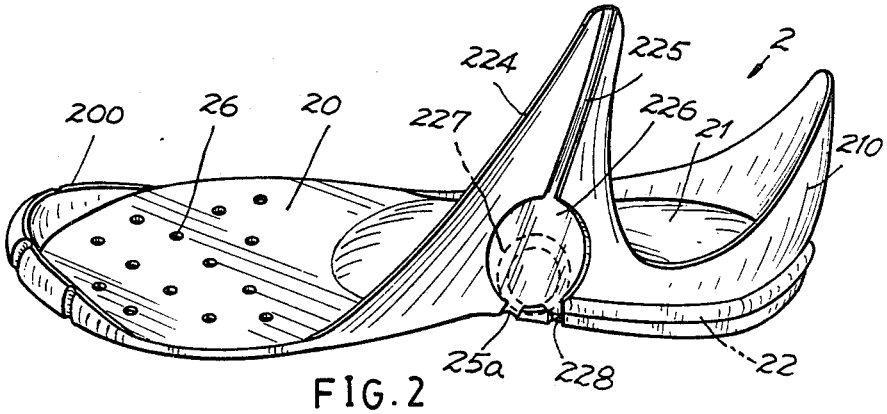
FIG. 2 is a perspective view of the insole of the present invention.
Figure 3:
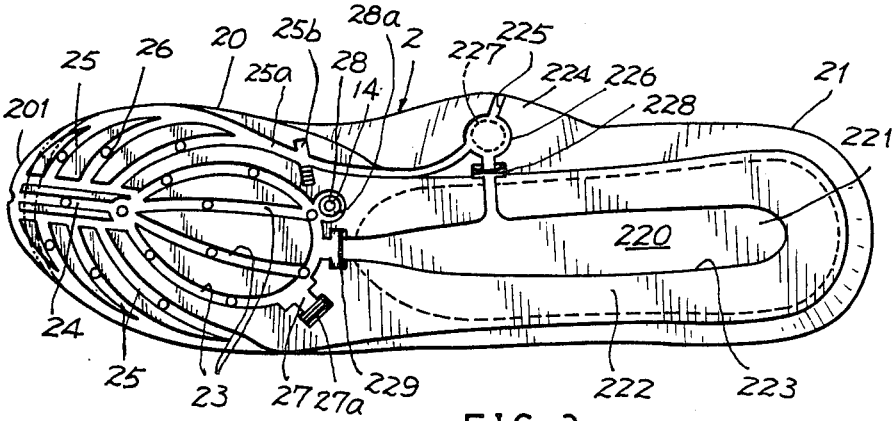
FIG. 3 is a bottom view of the insole of the present invention.
Figure 4:
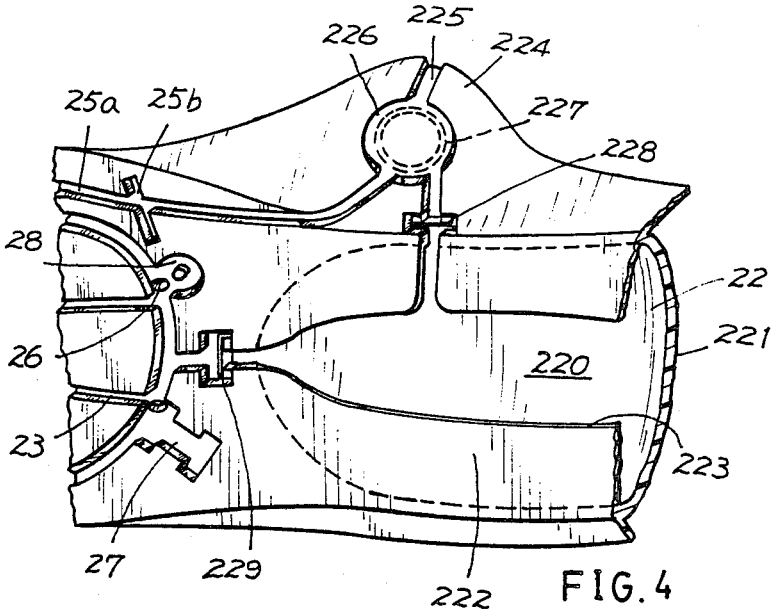
FIG. 4 is a partial illustration of the insole of the present invention.
Figure 5:
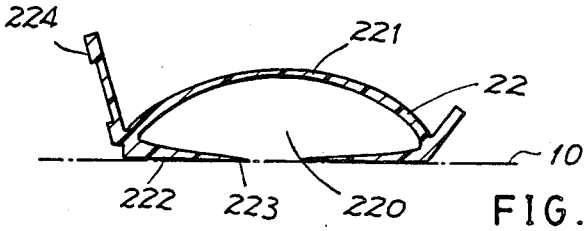
FIG. 5 is a transverse sectional drawing of the present invention.

The insole 2, having a front portion 20 and a rear portion 21, includes: an air pumping means 22 formed on the rear portion 21; a plurality of intermediate ventilating grooves 23 formed underneath the front portion 20 with each ventilating groove 23 protruding expansively to its middle portion and then contractively to its front portion to define a contour as generally shaped as an ellipse between the pumping means 22 and a toe portion 201 of the insole 2; plural longitudinal ventilating grooves 24 formed underneath the toe portion 201 fluidically communicated with the intermediate grooves 23; plural arcuate ventilating grooves 25 each generally parallel to an arcuate edge of the toe portion 201 and the front portion 20 and centrally intersecting with a longitudinal ventilating groove 24; and plural perforations 26 formed through the thickness of the insole 2 and distributively formed in the ventilating grooves 25, 24 and 23. As shown in FIG. 2, the insole 2 is formed with a front-edge extension 200 and a rear-edge extension 210 respectively on the front portion 20 and the rear portion 21 for snugly inserting the insole 2 into the shoe 1 above the sole 10.

The air pumping mean 22 preferably integratedly formed, such as by blow molding, with the insole 2 includes: an upper arcuate film 221 concave downwardly, a flat bottom film 222 circumferentially formed with a lowest periphery of the upper film 221, a longitudinal slot 223 formed on a central portion of the bottom film 222 adapted for mold release during molding process and snugly sealed by the sole 10 inside the shoe 1 under the insole, an air guide extension 224 protruding upwardly from a waist portion of the insole 2 having a generally vertical ventilating groove 225 formed on the extension 224 to fluidically communicate with the waist ventilating hole 11 formed on the vamp, a recess 226 formed on the extension 224 communicated with the groove 225 filled with a filter preferably impregnated with refreshing or perfuming agents or chemicals, an air intake valve 228 formed on the groove 225 communicated with a pumping chamber 220 defined between the upper film 221, the bottom film 222 and the sole 10 sealing the slot 223 of the bottom film 222, and an air exhaust valve 229 formed beneath the pumping chamber 220 and the intermediate ventilating grooves 23.

The height of the extension 224 may be adjusted by cutting the upper edge of the extension and once all the holes 12, 11 are sealed by tape, the extension 224 having its air guide 225 may be used for ventilating the air stream outwardly through a vamp opening.

All the grooves 23, 24, 25 are sealed by the sole 10 adjacent to the insole 2 when inserting the insole 2 into the shoe 1. One side arcuate ventilating groove 25*a* of the arcuate grooves 25 is protruded rearwardly to communicate with the recess 226 as controlled by a by-pass valve 25*b*. In order to enforce the elastic restoring function of the pumping means 22, different elastomers or cushioning pads (not shown) may be filled into the pumping chamber 220. For massage purpose, the upper surface of insole may be formed with plural beads or projections. Underneath the front portion 20 of insole 2, a first auxiliary socket 27 may be formed for inserting plural layers of adhesive tape 27*a* adapted for adjustably sealing a discharge opening of the exhaust valve 229 and a second auxiliary socket 28 is formed for inserting plural plugs 28*a* therein adapted for sealing the front ventilating hole 12 in case of rain. The insole 2 and the pumping means 22 may be made of elastic material or foam material to increase their elasticity.

Figure 6:
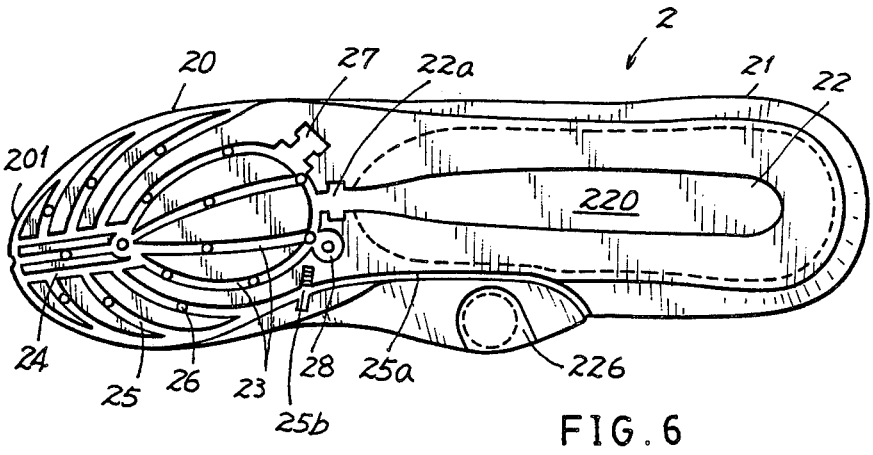
FIG. 6 is a bottom view of another preferred embodiment of the present invention.

Another preferred embodiment of the present invention is shown in FIG. 6, wherein the intake valve and exhaust valve of the pumping means 22 are omitted and substituted with an air inlet/outlet hole 22a beyond the pumping chamber 220. The recess 226 may also be filled with adhesive tape for sealing the hole 12 in case of rain.

In using the present invention and upon the stepping of the shoe 1 on a ground floor, the pumping means 22 is squeezed to compress air in chamber 220 to flow through exhaust valve 229, grooves 23, 24, 25, and then upwardly through the perforations 26 to comfort a wear's foot above the insole 2, whereby the exhaust air is finally discharged through the upper opening. When the shoe 1 is lifted from the ground floor, the environmental fresh air will be sucked through the vamp hole 11 into the pumping chamber 220 by intake valve 228. Alternatively, the stepping and lifting of the shoe will pump the air circulatively in the shoe and the insole for sound ventilation for hygienic purpose. In case of raining, the tape as wound on the lace 15 or stored in recess 226 or the plug as stored in socket 28 may be used to seal the front hole 12.

The above-mentioned air ventilation can be changed in direction, for instance, such that the dirty air can be sucked from a suction valve substituting the aforementioned valve 229 and discharged through an exhaust valve substituting the aforementioned intake valve 228 for a counter air flow opposite to that as above-mentioned.

The side ventilating groove 25*a* as directed rearwardly to the recess 226 serves as a by-pass way for a local circulation system by directly filtering a by-pass air stream through the groove 25*a* as controlled or even stopped by the valve 25*b*, which air stream is then directed into the chamber 220 for its continuous circulation.

The elastic pumping means 22, besides its air ventilation effect, may also serve to absorb a shock during walking or to have a massage effect due to its squeezing and expanding operations.

Accordingly, the present invention is superior to the prior U.S. Pat. No. 4,633,597 with the following advantages:

1. The air pumping means 22 may be integratedly formed to save the production cost and convenience.

2. If the front portion 20 of the insole 1 is not suitable for matching the wearer's toes, it can be cut or modified for snug wearing and even several outer arcuate ventilating grooves 25 being already cut off as shown in dotted line of FIG. 3, the inner grooves 25, 24 are still working to ensure the sound air circulation of the present invention.

3. The recess 226 is filled with filter and refreshing agent or perfume for cleaning the circulated air, or for dust prevention, or for comforting a wearer's foot.

4. Even in a rainy day, the shoe of the present invention can be worn without worrying about the penetration of rain water into the shoe since the front ventilating hole can be sealed by plug 14 or tape 15 (The waist hole 11 may always be covered by a wearer's trouser for it water proof).

I claim:

1. An insole-ventilating shoe comprising:

a shoe having a waist ventilating hole formed on a waist portion of a vamp and a front ventilating hole formed on a toe cap; and an insole having a front portion formed with plural ventilating grooves underneath said front portion of said insole and a rear portion formed with an air pumping means thereon, said plural ventilating grooves fluidically communicated with said air pumping means;

the improvement which comprises:

said air pumping means preferably made of elastic material integratedly formed with said insole including: an upper arcuate film concave downwardly, a flat bottom film circumferentially formed with a lowest periphery of said upper film, a longitudinal slot formed on a central portion of said bottom film as snugly sealed by a sole inside said shoe under said insole, an air guide extension protruding upwardly from a waist portion of said insole having a generally vertical ventilating groove formed on said air guide extension to fluidically communicate with said waist ventilating hole on said vamp, a recess formed on said air guide extension as communicated with said vertical ventilating groove and filled with a filter preferably impregnated with refreshing agents or perfumes, an air intake valve formed on said vertical groove and communicated with a pumping chamber defined between said upper film, said bottom film and said sole sealing said longitudinal slot of said bottom film, and an air exhaust valve formed between said pumping chamber and said ventilating grooves formed on said front portion; and said plural ventilating grooves including: plural intermediate ventilating grooves formed underneath said front portion having each groove protruded expansively to its middle portion and then contractively to its front portion to define a generally elliptic contour between said pumping chamber and a toe portion of said insole, plural longitudinal ventilating grooves formed underneath said toe portion fluidically communicated with said intermediate ventilating grooves, plural arcuate ventilating grooves each generally parallel to an arcuate edge of the toe portion and the front portion of said insole and centrally intersecting with one said longitudinal ventilating groove, and plural perforations distributively formed in said ventilating grooves through said thickness of said insole, whereby upon the stepping of said shoe on a ground, the air in said pumping chamber will be compressed to flow through said exhaust valve, said ventilating grooves and said perforations for comforting a wearer's foot, and upon the lifting of said shoe from the ground, the environmental fresh air will be sucked through said waist ventilating hole into said pumping chamber as filtered by said filter in said recess of said pumping means.

2. An insole-ventilating shoe according to claim 1, wherein said shoe further includes a shoelace having one tip mounted with a plug and having the other tip wound with a tape, adapted for sealing said front ventilating hole in case of rain.

3. An insole-ventilating shoe according to claim 1, wherein said insole further includes plural sockets and recess filled with tapes or plugs, adapted for sealing said front ventilating hole or for adjusting the opening of each said valve.

4. An insole-ventilating shoe according to claim 1, wherein said arcuate ventilating grooves include one side by-pass ventilating groove protruding rearwardly to communicate with said recess of said air pumping means, adapted for local air circulation between said pumping chamber and said ventilating grooves, as controlled by a by-pass valve formed thereon.

5. An insole-ventilating shoe according to claim 1, wherein said ventilating grooves and said slot of said pumping means of said insole are all sealed by said sole inside said shoe as positioned under said insole.

6. A shoe according to claim 1, wherein said insole is formed with a front-edge extension and a rear-edge extension respectively in the front and rear portions of said insole, adapted for its snug insertion into the shoe.

* * * * *